US010718078B2

(12) United States Patent
Han et al.

(10) Patent No.: US 10,718,078 B2
(45) Date of Patent: Jul. 21, 2020

(54) METHOD FOR MANUFACTURING CIRCULAR KNITTING FUSIBLE INTERLINING HAVING OUTER EDGE FORMING PROCESS BY THERMAL FIXING, AND THE FUSIBLE INTERLINING MANUFACTURED BY THE METHOD

(71) Applicant: JJ TRADING CO., LTD., Seoul (KR)

(72) Inventors: Soon-Koo Han, Seoul (KR); Doo-Yeon Kim, Seoul (KR); Jung-Min Han, Seoul (KR)

(73) Assignee: JJ TRADING CO., LTD., Seoul (KR)

( * ) Notice: Subject to any disclaimer, the term of this patent is extended or adjusted under 35 U.S.C. 154(b) by 0 days.

(21) Appl. No.: 16/470,108

(22) PCT Filed: Aug. 24, 2017

(86) PCT No.: PCT/KR2017/009235
§ 371 (c)(1),
(2) Date: Jun. 14, 2019

(87) PCT Pub. No.: WO2018/110796
PCT Pub. Date: Jun. 21, 2018

(65) Prior Publication Data

US 2019/0316286 A1 Oct. 17, 2019

(30) Foreign Application Priority Data

Dec. 15, 2016 (KR) ..... 10-2016-0171334

(51) Int. Cl.
*D06C 25/00* (2006.01)
*A41D 27/02* (2006.01)
*A41D 31/02* (2019.01)

(52) U.S. Cl.
CPC ..... *D06C 25/00* (2013.01); *A41D 27/02* (2013.01); *A41D 31/02* (2013.01); *A41D 2500/10* (2013.01)

(58) Field of Classification Search
CPC ..... D06C 25/00; A41D 27/02; A41D 31/02; A41D 2500/10
See application file for complete search history.

(56) References Cited

FOREIGN PATENT DOCUMENTS

JP 2004308037 A * 11/2004
JP 2016-522763 A 8/2016
(Continued)

OTHER PUBLICATIONS

Fabric usage & various fabric losses in cutting room, The Indian Textile Journal, Jul. 2008, accessed Feb. 20, 2020 from https://indiantextilejournal.com/articles/FAdetails.asp?id=1307 (Year: 2008).*
(Continued)

*Primary Examiner* — Kelly M Gambetta
(74) *Attorney, Agent, or Firm* — Stein IP, LLC

(57) ABSTRACT

Provided are a method for manufacturing circular knitting fusible interlining having an outer edge forming process by thermal fixing and the fusible interlining manufactured by the method. The method for manufacturing circular knitting fusible interlining having an outer edge forming process by thermal fixing, includes: (a) flatly unfolding a circular knitting unprocessed fabric cut after being knitted with a solution dyed yarn; (b) applying hot air to both edges of the circular knitting unprocessed fabric that are cut and rolled and performing thermal fixing thereon; (c) putting the circular knitting unprocessed fabric having the thermally-fixed edges into a heating cylinder and producing a processed fabric having bulkiness due to thermal contraction; and (d) applying an adhesive to the processed fabric to produce fusible interlining.

1 Claim, 6 Drawing Sheets

(56) References Cited

FOREIGN PATENT DOCUMENTS

| | | | |
|---|---|---|---|
| KR | 10-1998-0008085 | A | 4/1998 |
| KR | 2002-0084837 | A | 11/2002 |
| KR | 10-1457548 | B1 | 11/2014 |
| KR | 10-1585496 | B1 | 1/2016 |
| KR | 10-1737913 | B1 | 5/2017 |

OTHER PUBLICATIONS

International Search Report dated Nov. 27, 2017, issued to International Application No. PCT/KR2017/009235.

* cited by examiner

METHOD FOR MANUFACTURING CIRCULAR KNITTING FUSIBLE INTERLINING HAVING OUTER EDGE FORMING PROCESS BY THERMAL FIXING, AND THE FUSIBLE INTERLINING MANUFACTURED BY THE METHOD

CROSS-REFERENCE TO RELATED APPLICATIONS

This application is a national stage of International Application No. PCT/KR2017/009235, filed Aug. 24, 2017, which claims the benefit of Korean Application No. 10-2016-0171334, filed Dec. 15, 2016, in the Korean Intellectual Property Office, the disclosures of which are incorporated herein by reference.

TECHNICAL FIELD

The present invention relates to a method for manufacturing circular knitting fusible interlining, and the fusible interlining manufactured by the method, and more particularly, to a method for manufacturing circular knitting fusible interlining having an outer edge forming process by thermal fixing, and the fusible interlining manufactured by the method.

BACKGROUND ART

In general, fusible interlinings are used in clothing products so as to improve functionality, stability, and volume of outer fabrics by patching inner sides of the outer fabrics and reinforcing the outer fabrics.

The fusible interlinings can be manufactured by processing a circular knitting unprocessed fabric. Here, the circular knitting unprocessed fabric is a raw fabric made flat from a tube-shaped knitted fabric by future cutting. As photographed in FIG. 1, when the circular knitting unprocessed fabric is cut, due to characteristics of the raw fabric, a phenomenon that a cut edge of the circular knitting unprocessed fabric is rolled, occurs. A process in which the edge of the circular knitting unprocessed fabric is kept flat not to be rolled for processing, is called an outer edge forming process.

A method for manufacturing fusible interlining according to the related art includes a pre-processing process of processing a circular knitting unprocessed fabric, a dyeing process, a cleaning process, a dehydration process, a flexibility and width processing process, and an adhesion process.

Here, the pre-processing process is a process of removing oil having the purpose of lubrication used to manufacture a raw yarn or to make an unprocessed fabric or other impurities added during a process, the dyeing process is a process of dyeing the raw fabric so as to make a desired color, the cleaning process is a process of removing residues of dyes and various kinds of preparations used to perform the dyeing process (wherein the color fastness (stability of color) of a dyed material depends on the degree of cleaning), the dehydration process is a process of minimizing moisture of the raw fabric after the cleaning process has been performed (wherein the efficiency of processing in subsequent processes is maximized in a state in which moisture is minimized), the flexibility and width processing process is a process of determining a desired completion width with a desired degree of softness, and the adhesion process is a process of applying an adhesive to the raw fabric to have an adhesion performance.

In particular, in the width processing process, an appropriate amount of resin is applied to both ends of the raw fabric so as to form the outer edge, and an outer portion of the desired completion width is cut. FIG. 2 is a photo showing a processed fabric having an outer edge formed according to the related art.

However, in the method for manufacturing fusible interlining according to the related art, there are so many processes up to the adhesion process of applying the adhesive to the raw fabric so that a production lead time is long and due to slope direction tension applied while undergoing several processes, the used raw yarn is pulled and thus becomes smaller than its original thickness so that it is difficult to stably seat the adhesive during the adhesion process, and furthermore, the rolled outer portion of the raw fabric during outer edge forming is cut so that a waste of the raw fabric is severe.

DETAILED DESCRIPTION OF THE INVENTION

Technical Problem

The present invention provides a method for manufacturing circular knitting fusible interlining having an outer edge forming process by thermal fixing, whereby a manufacturing process is simplified by using a circular knitting unprocessed fabric knitted with a solution dyed yarn and forming an outer edge by thermal fixing so that energy reduction, a reduction in a production lead time, cost reduction, a reduction in a waste of a raw fabric and more stable seating of an adhesive during adhesion can be realized, and the fusible interlining manufactured by the method.

Technical Solution

According to an aspect of the present invention, there is provided a method for manufacturing circular knitting fusible interlining having an outer edge forming process by thermal fixing, the method including: (a) flatly unfolding a circular knitting unprocessed fabric cut after being knitted with a solution dyed yarn; (b) applying hot air to both edges of the circular knitting unprocessed fabric that are cut and rolled and performing thermal fixing thereon; (c) putting the circular knitting unprocessed fabric having the thermally-fixed edges into a heating cylinder and producing a processed fabric having bulkiness due to thermal contraction; and (d) applying an adhesive to the processed fabric to produce fusible interlining.

Advantageous Effects

According to the present invention, outer edge forming required for processing, such as width fixing, can be performed in all circular knitting products produced regardless of the structure or performance of a knitting machine, and the present invention has the following advantages.

First, a dyeing process, a cleaning process, a dehydration process and a flexibility process, according to the related art can be removed by using a solution dyed yarn so that a manufacturing process can be simplified and thus 1) water required for a dyeing finishing process can be saved down to zero, after input of an unprocessed fabric to output of a final coated products, which can be an Ecofriendly Coating Technology in compliance with the policy of ESSD (Environmentally Sound and Sustainable Development), 2) energy required for the dyeing finishing process can be reduced down to 50% more or less, 3) a production lead time can be shortened by half thanks to the removed finishing processes and 4) other meaningful savings, such as dyestuffs, chemicals etc. in addition to the man power saving can be achieved.

Second, bulkiness of a fusible interlining in a state of an unprocessed fabric is acquired through a heating cylinder, and the fusible interlining is directly coated so that, due to high bulkiness and rich concentration, dots of an adhesive seated on a raw yarn can be more stabilized.

MODE OF THE INVENTION

Hereinafter, exemplary embodiments of the present invention will be described in detail with reference to the attached drawings.

Figure 1:
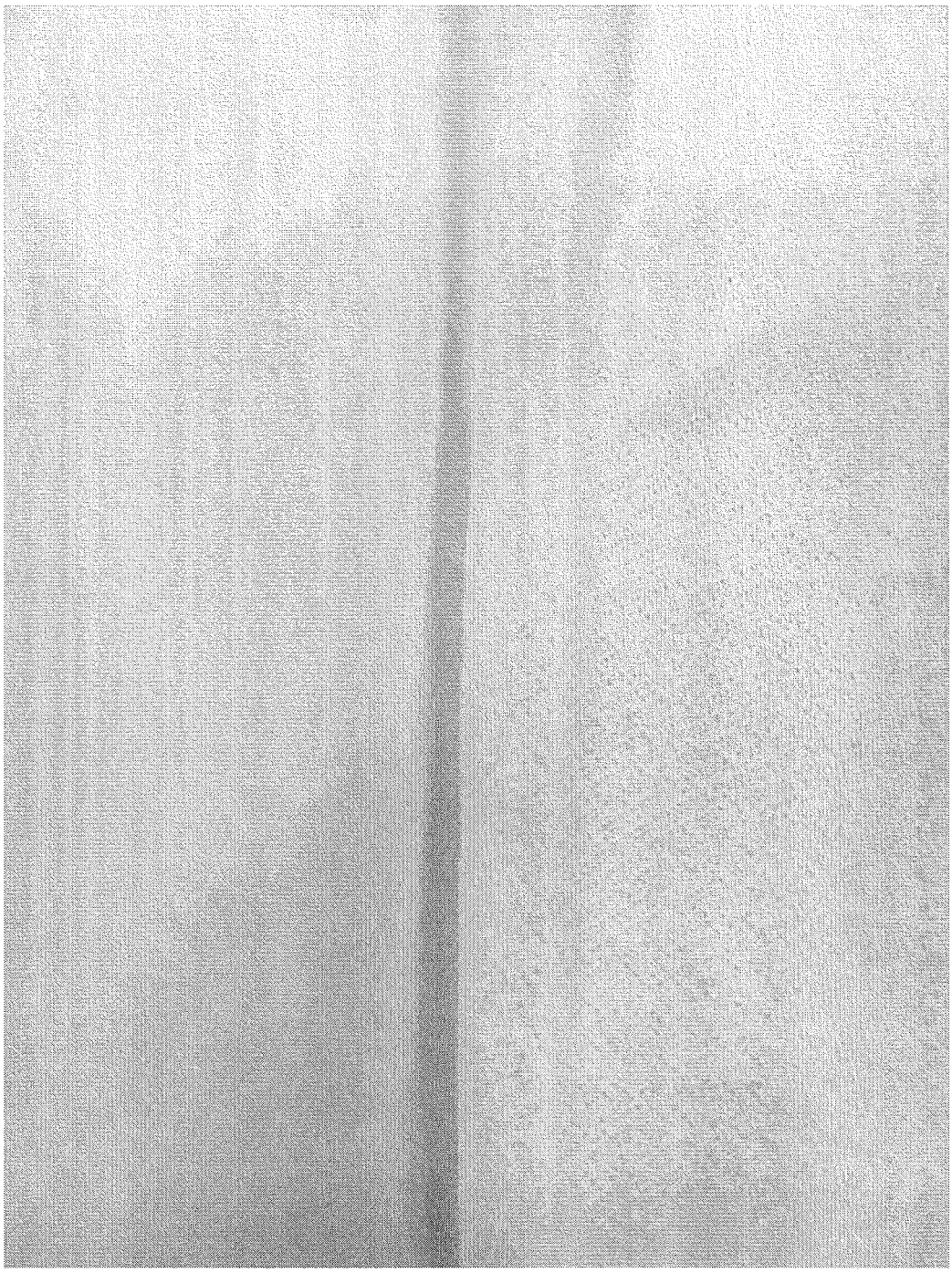
FIG. 1 is a photo showing a part of a left edge of a circular knitting unprocessed fabric using a general yarn.
Figure 2:
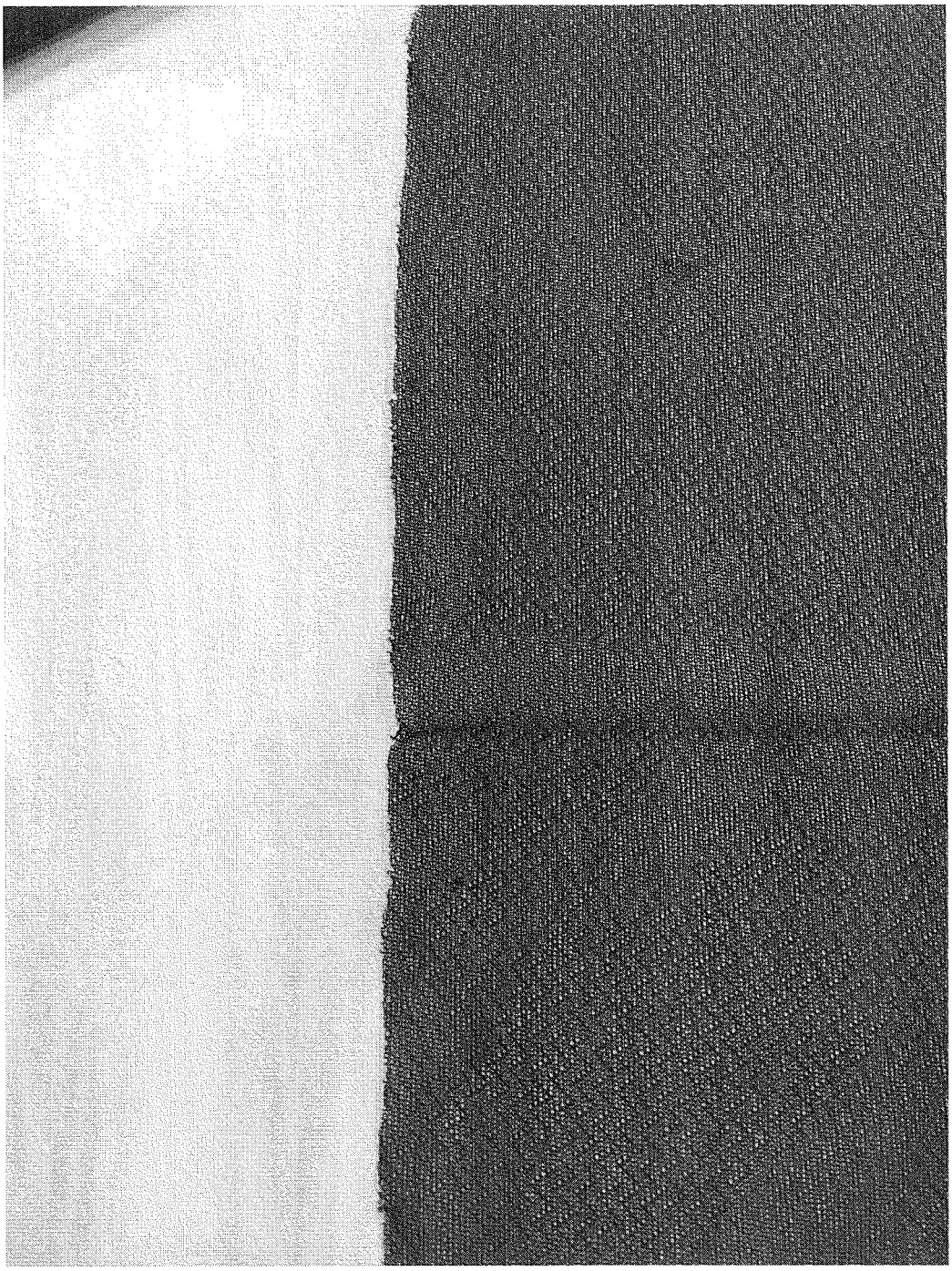
FIG. 2 is a photo showing a part of a left edge of a processed fabric having an outer edge manufactured by the related art.
Figure 3:
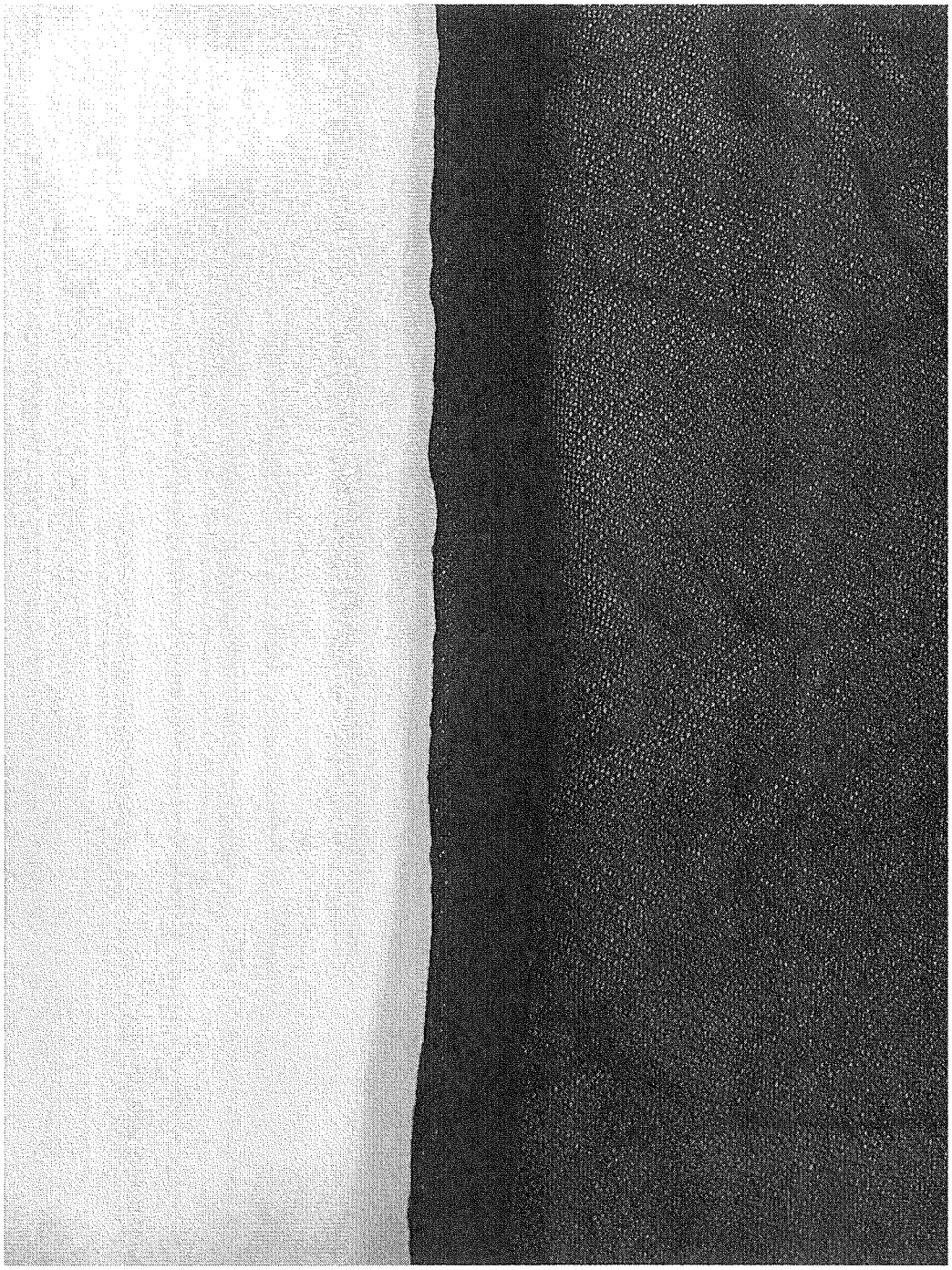
FIG. 3 is a photo showing a part of a left edge of a circular knitting unprocessed fabric using a solution dyed yarn.

First, in order to manufacture circuit knit fusible interlining having an outer edge forming process by thermal fixing according to the present invention, a circular knitting unprocessed fabric (see FIG. 3) cut after being knitted in a circular knitting manner using a solution dyed yarn is used.

The solution dyed yarn is a color yarn made by coloring an undiluted solution used to make a raw yarn made of polyester, nylon solely or a mixed material, for example. The solution dyed yarn includes several colors including black. When a final desired color of the fusible interlining is an undyed color (general off white), a non-solution dyed yarn (a general yarn) that is not the solution dyed yarn may be used. Thus, the solution dyed yarn in the following descriptions refers to a yarn that has a final desired color of the fusible interlining and thus is not required to be dyed any more as well as an existing solution dyed yarn.

When the circular knitting unprocessed fabric knitted with the solution dyed yarn is used, a dyeing process, a cleaning process, a dehydration process, and a flexibility process according to the related art can be removed so that a manufacturing process can be simplified.

Figure 4A:
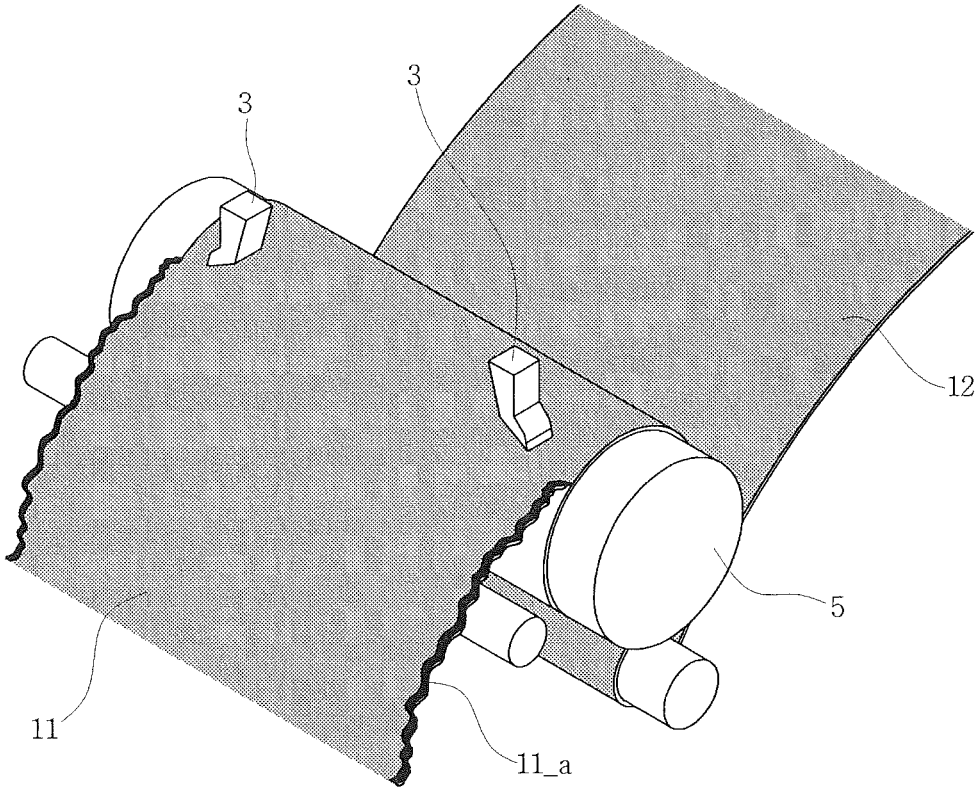
FIG. 4A is a perspective view of the device for forming gumming according to the present invention.
Figure 4B:
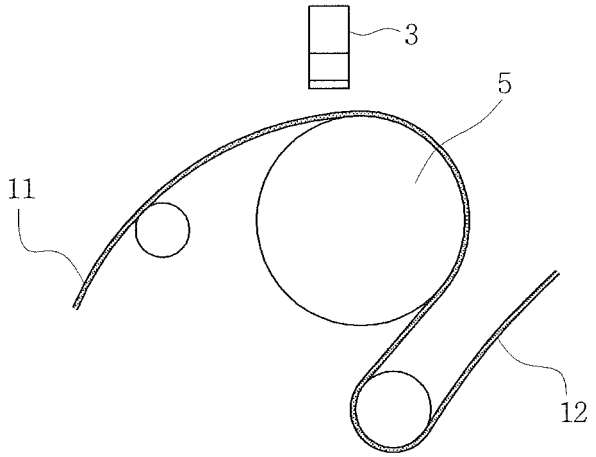
FIG. 4B is a side view of the device for forming gumming according to the present invention.

A method for manufacturing circular knitting fusible interlining according to the present invention includes a process of forming gumming using a device for forming an outer edge illustrated in FIG. 4A and FIG. 4B.

First, in order to easily unfold a circular knitting unprocessed fabric 11 knitted with the solution dyed yarn, the circular knitting unprocessed fabric 11 is prepared in a rolled state so that a cut surface of the circular knitting unprocessed fabric 11 is in an upward direction.

The circular knitting unprocessed fabric 11 is put into a device 1 for forming an outer edge while no much tension is applied to the device 1 for forming the outer edge as possible so that the folded and rolled circular knitting unprocessed fabric 11 can be well unfolded.

The circular knitting unprocessed fabric 11 put into the device 1 for forming the outer edge is kept in a maximally-unfolded state to be suitable for two hot air suppliers 3 disposed at both sides of the circular knitting unprocessed fabric 11, and an outer edge is formed at both edges 11_*a* that are cut and rolled, in a thermal fixing manner due to hot air of high-temperature heat supplied from the hot air suppliers 3.

Here, thermal fixing refers to improving dimension stability by removing local warping that occurs during a forming process through thermal treatment. That is, thermal fixing is called in a sense of fixing a shape during the forming process.

In this case, preferably, hot air supplied by the hot air suppliers 3 is 180° C. to 250° C.

Also, hot air is supplied by the hot air suppliers 3 to be inclined toward outsides of the edges 11_*a* of the circular knitting unprocessed fabric, and the circular knitting unprocessed fabric is thermally fixed in a state in which the rolled edges 11_*a* of the circular knitting unprocessed fabric are unfolded.

Next, an unprocessed fabric having an outer edge formed by thermal fixing in a well-unfolded state is put into a heating cylinder 5. The heating cylinder 5 includes an electrical heating pipe installed inside thereof and heats the electrical heating pipe and thus is maintained at 100° C. to 300° C.

Figure 5:
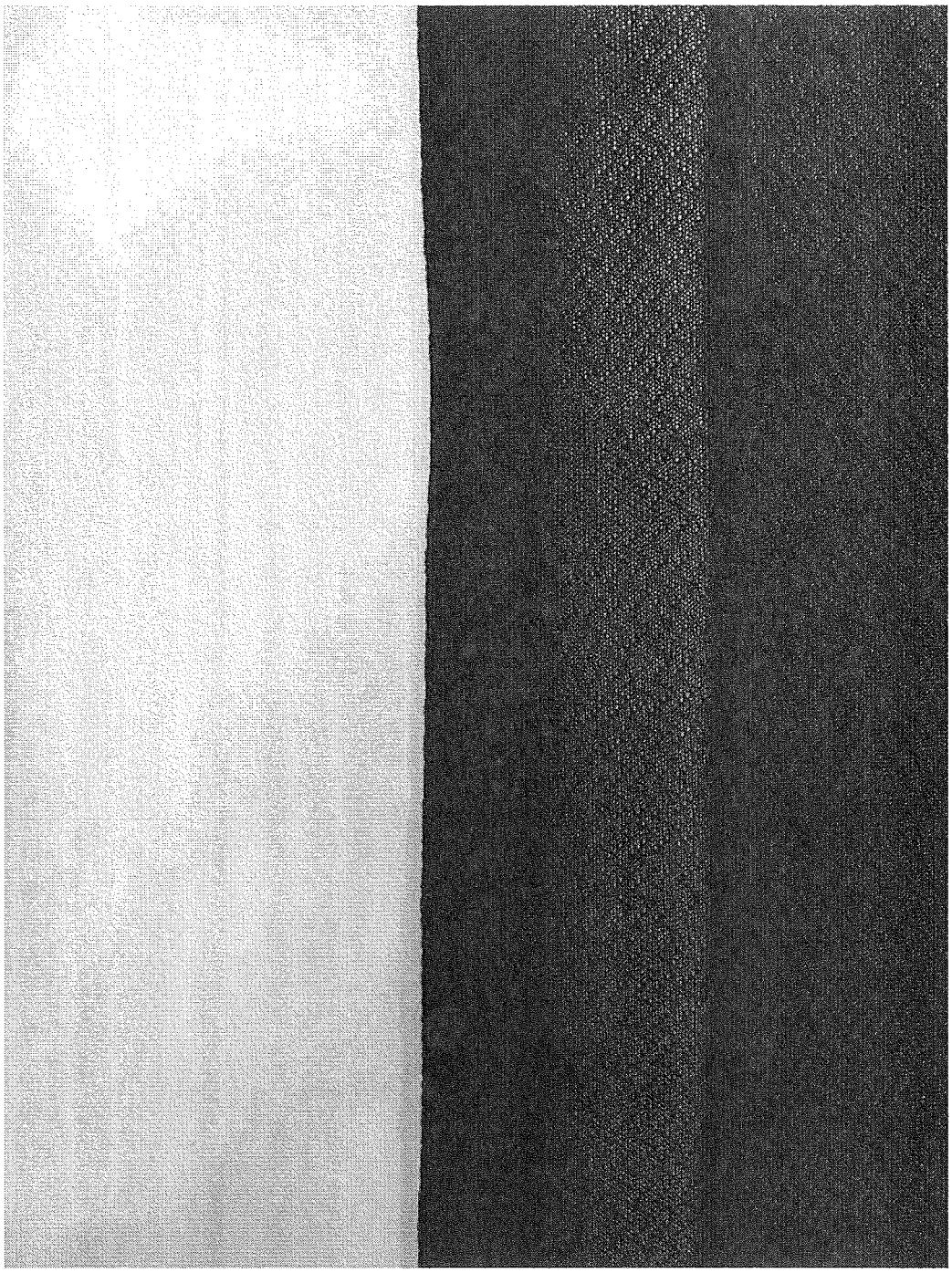
FIG. 5 is a photo showing a part of a left edge of a processed fabric having a formed outer edge manufactured according to the present invention.

The unprocessed fabric is manufactured as a processed fabric 12 (see FIG. 5) having bulkiness due to thermal contraction by using the heating cylinder 5.

In more detail, when a draw textured yarn (DTY) having the purpose of attaining elasticity is used as the raw yarn, crimp occurs when the raw yarn is drawn and is twisted in one direction on a predetermined tensile condition, is slightly thermally fixed and is twisted again in an opposite direction. This crimp is a basic unit for having elasticity. The twisting performance of the DTY during processing of the raw yarn is restored by the crimp, and the DTY has bulkiness when meeting a proper temperature.

Furthermore, in the process of forming gumming, oil having the purpose of lubrication used to manufacture the raw yarn or to make the unprocessed fabric or other impurities added during a process are removed by hot air and the heating cylinder so that a function corresponding to a pre-processing process according to the related art can also be performed.

Figure 6:
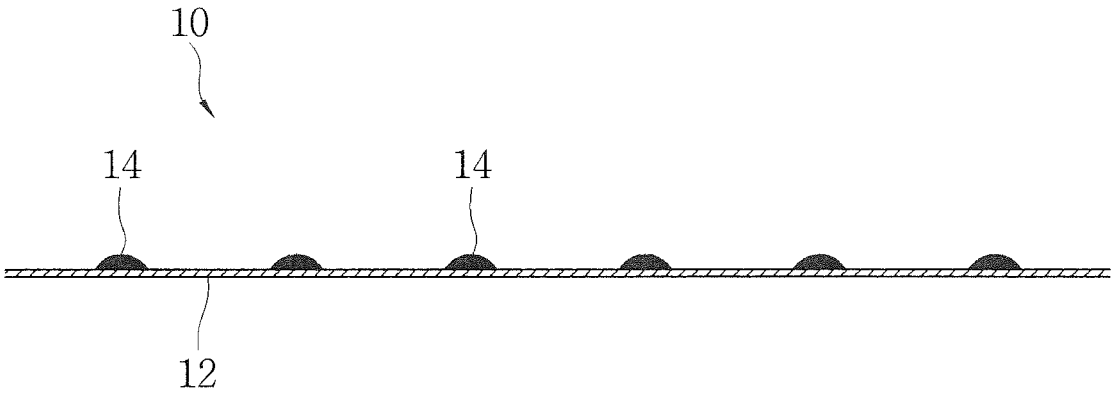
FIG. 6 illustrates a configuration of fusible interlining according to the present invention.

Subsequently, when a hot melt adhesive 14 in a powder, liquid or molten state is applied onto the processed fabric 12 using an appropriate coating method, fusible interlining 10 is produced. FIG. 6 illustrates the hot melt adhesive 14 having a shape of dots distributed according to a predetermined rule. However, the scope of the invention is not necessarily limited thereto.

The invention claimed is:

1. A method for manufacturing circular knitting fusible interlining having an outer edge forming process by thermal fixing, the method comprising:

(a) flatly unfolding a circular knitting unprocessed fabric cut after being knitted with a solution dyed yarn;

(b) applying hot air to both edges of the circular knitting unprocessed fabric that are cut and rolled and performing thermal fixing thereon;

(c) putting the circular knitting unprocessed fabric having the thermally-fixed edges into a heating cylinder and producing a processed fabric having bulkiness due to thermal contraction; and (d) applying an adhesive to the processed fabric to produce fusible interlining, wherein, in (b), the hot air is supplied to be inclined toward outsides of the edges of the circular knitting unprocessed fabric.

* * * * *